US011491753B2

(12) United States Patent
Rosser, Jr.

(10) Patent No.: US 11,491,753 B2
(45) Date of Patent: Nov. 8, 2022

(54) PRECOMPRESSION CHARGING CHAMBER FOR A COMPACTOR

(71) Applicant: Fulton F. Rosser, Jr., Cobb, GA (US)

(72) Inventor: Fulton F. Rosser, Jr., Cobb, GA (US)

( * ) Notice: Subject to any disclaimer, the term of this patent is extended or adjusted under 35 U.S.C. 154(b) by 453 days.

(21) Appl. No.: 16/393,559

(22) Filed: Apr. 24, 2019

(65) Prior Publication Data

US 2019/0322063 A1 Oct. 24, 2019

Related U.S. Application Data

(60) Provisional application No. 62/661,961, filed on Apr. 24, 2018.

(51) Int. Cl.
*B30B 9/30* (2006.01)

(52) U.S. Cl.
CPC ..... *B30B 9/3078* (2013.01); *B30B 9/301* (2013.01)

(58) Field of Classification Search
CPC ..... B30B 9/301; B30B 9/30; B30B 9/3003; B30B 9/3078; B30B 9/3085; B30B 12/00; B30B 15/04; B30B 7/04
See application file for complete search history.

(56) References Cited

U.S. PATENT DOCUMENTS 4,573,403 A * 3/1986 Van Doorn ..... B30B 9/30 100/215
4,594,942 A * 6/1986 Denneboom ..... B30B 9/301 100/137
5,029,522 A * 7/1991 Brisson ..... B30B 9/3014 100/233
5,193,454 A * 3/1993 Bollegraaf ..... B30B 7/04 100/142
5,845,568 A * 12/1998 Rosser, Jr. ..... B30B 9/3078 100/190
6,694,871 B1 * 2/2004 Wildes ..... B30B 9/3007 100/190
2007/0028787 A1 * 2/2007 Olds ..... B30B 9/3078 100/240
2010/0018415 A1 * 1/2010 Wincott ..... B30B 9/3021 100/39
2010/0095854 A1 * 4/2010 Strautmann ..... B65B 13/20 100/3

* cited by examiner

*Primary Examiner* — Jessica Cahill
*Assistant Examiner* — Bobby Yeonjin Kim
(74) *Attorney, Agent, or Firm* — Nelson Mullins Riley & Scarborough LLP

(57) ABSTRACT

A precompression charging chamber for a compactor having a frame, including a bottom wall, a left side wall that is movable from a first position that is perpendicular to the bottom wall to a second position that forms an obtuse angle with the bottom wall, a left top cover that is pivotably mounted to the left side wall and defines a left lock pin receptor, and a left lock pin that is movable from a first position in which the left lock pin is received within a left lock pin receptor defined by the frame and a second position in which the left lock pin is received within the left lock pin receptor of the left top cover, wherein the left side wall is non-pivotably fixed to the frame when the left lock pin is in the first position.

10 Claims, 17 Drawing Sheets

PRECOMPRESSION CHARGING CHAMBER FOR A COMPACTOR

CLAIM OF PRIORITY

This application claims priority to U.S. Provisional Patent Application No. 62/661,961 filed Apr. 24, 2018, the entire disclosure of which is incorporated by reference herein.

FIELD OF THE INVENTION

The present invention relates generally to compacting assemblies for loose materials. More particularly, the present invention relates to precompression charging chambers for those compacting assemblies used in baling loose cotton.

BACKGROUND

Prior art precompression charging chambers form parts of a loose waste material compacting apparatus for use with balers, and other equipment utilizing pivoting compression walls, and pivoting top covers. Such precompression charging chambers use individual and independent activating cylinders for each pivoting side wall, and each pivoting top cover, thereby, increasing the costs of such equipment, parts, and maintenance.

The present invention recognizes and addresses the foregoing considerations, and others, of prior art constructions and methods.

SUMMARY OF THE INVENTION

One embodiment of the present invention is a precompression charging chamber for a loose material compactor having a frame, the precompression charging chamber includes a bottom wall, a left side wall that is pivotably mounted to the frame of the compactor so that the left side wall is movable from a first position in which the left side wall is perpendicular to the bottom wall to a second position in which the left side wall defines an obtuse angle with the bottom wall, a left top cover that is pivotably mounted to a top edge of the left side wall and defines a left lock pin receptor, and a left lock pin that is secured to the left side wall, the left lock pin being movable from a first position in which a first end of the left lock pin is received within a left lock pin receptor defined by the frame and a second position in which a second end of the left lock pin is received within the left lock pin receptor of the left top cover, wherein the left side wall is non-pivotably fixed to the frame when the first end of the left lock pin is in the first position, and the left top cover is non-pivotably fixed to the left side wall when the second end of the left lock pin is in the second position.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
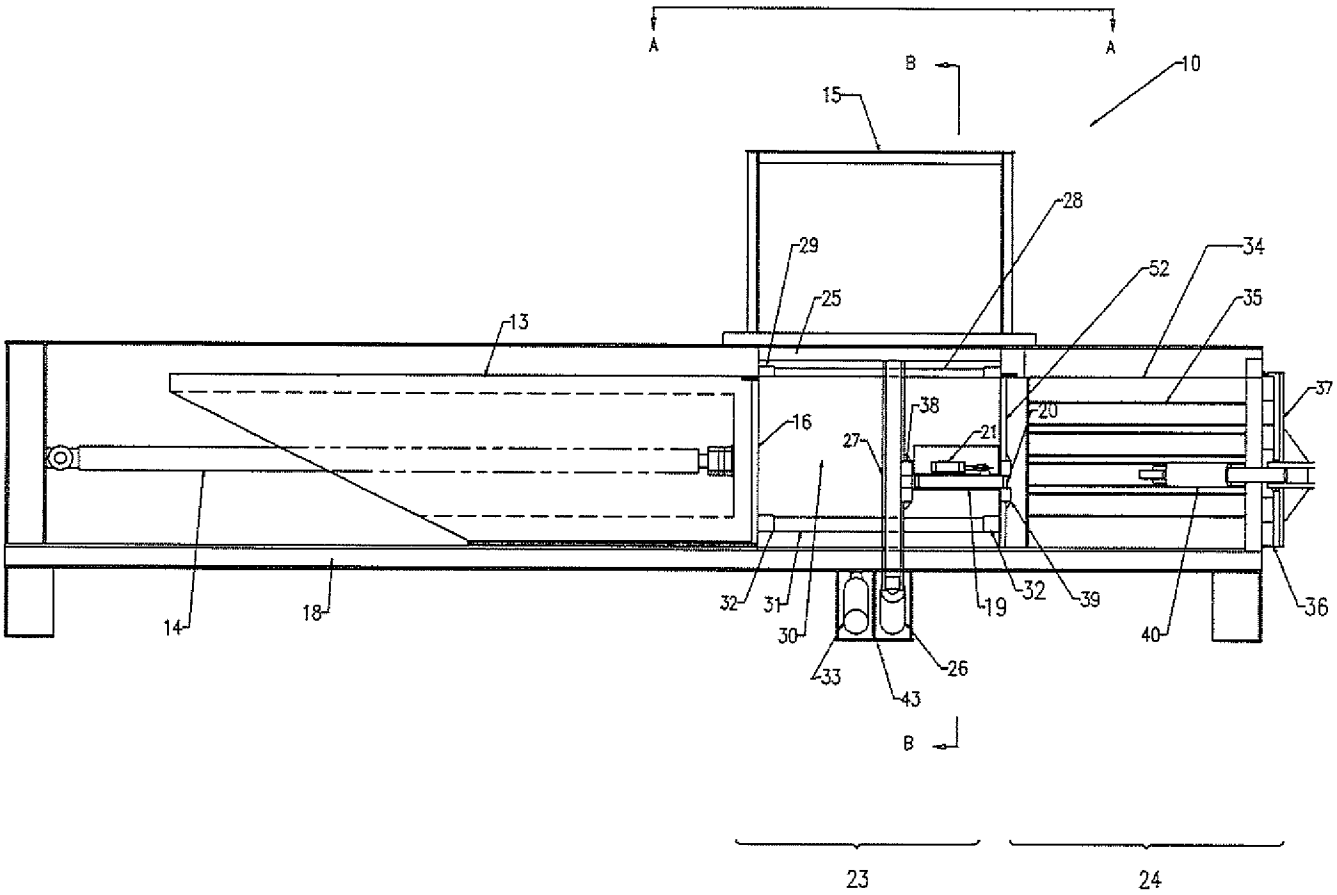
FIG. 1 illustrates a side view in partial cross section of a compactor (10) incorporating a pivoting left side wall (30) attached with a pivoting left top cover (25) and a pivoting right side wall (44) with a non-pivoting right top cover (48), in accordance with an embodiment of the present invention.

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
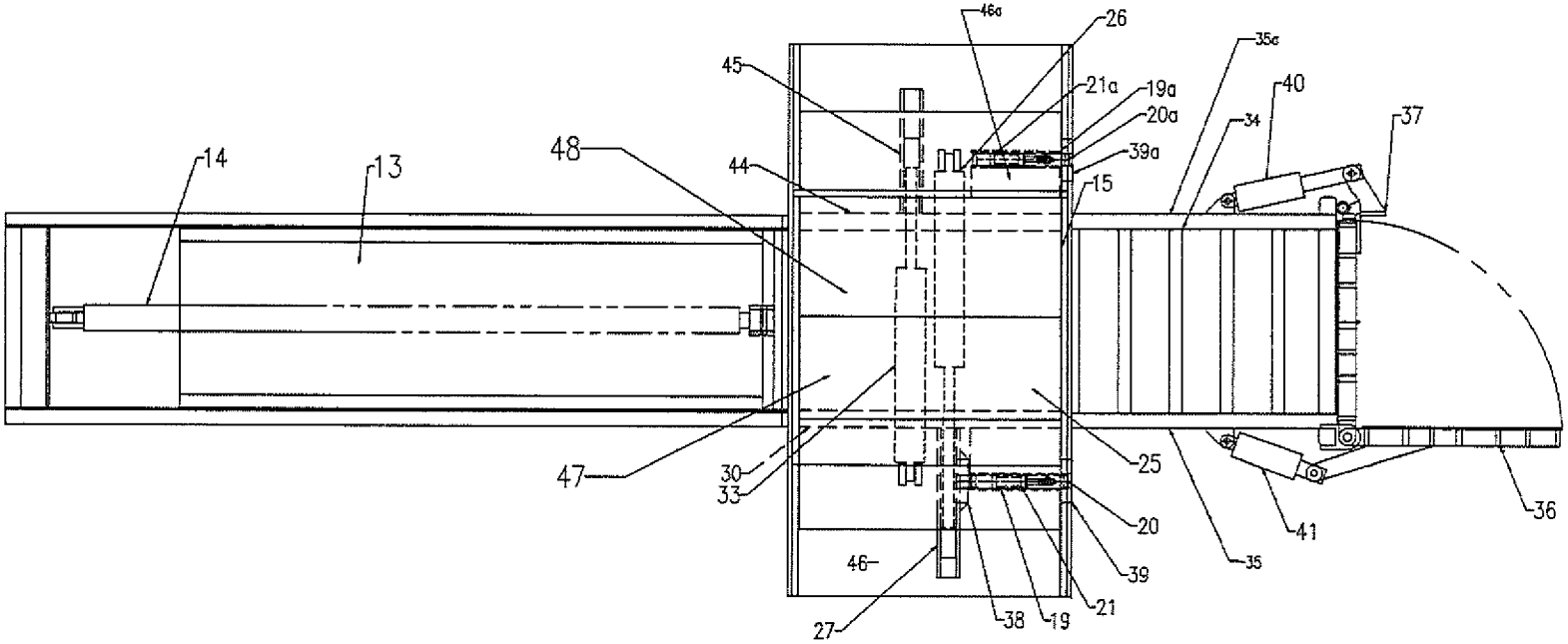
FIG. 2 illustrates a top view of the compactor (10)
Figure 5:
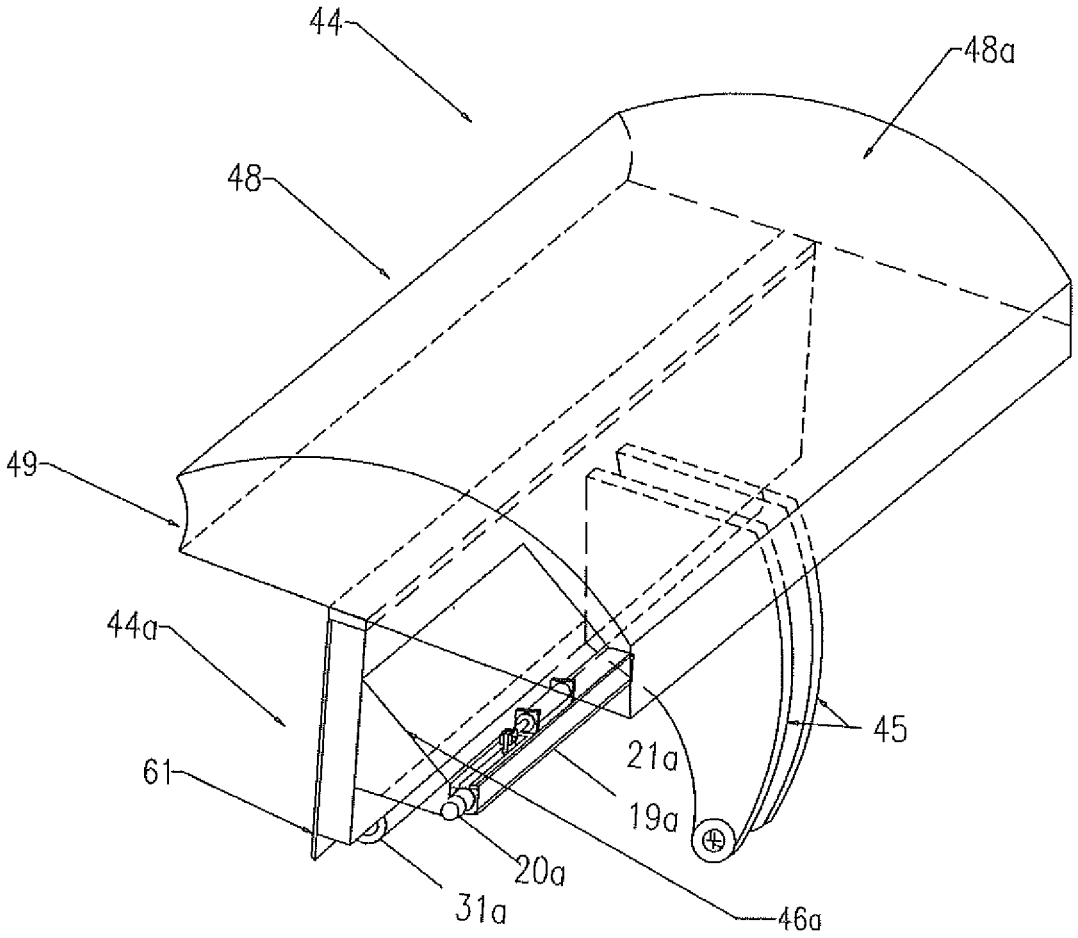
FIG. 5 illustrates an isometric view of an opposing pivoting right side wall (44) including a rigidly affixed non-pivoting right top cover (48) and right lock mechanism (19*a*, 20*a*, 21*a*)
Figure 8:
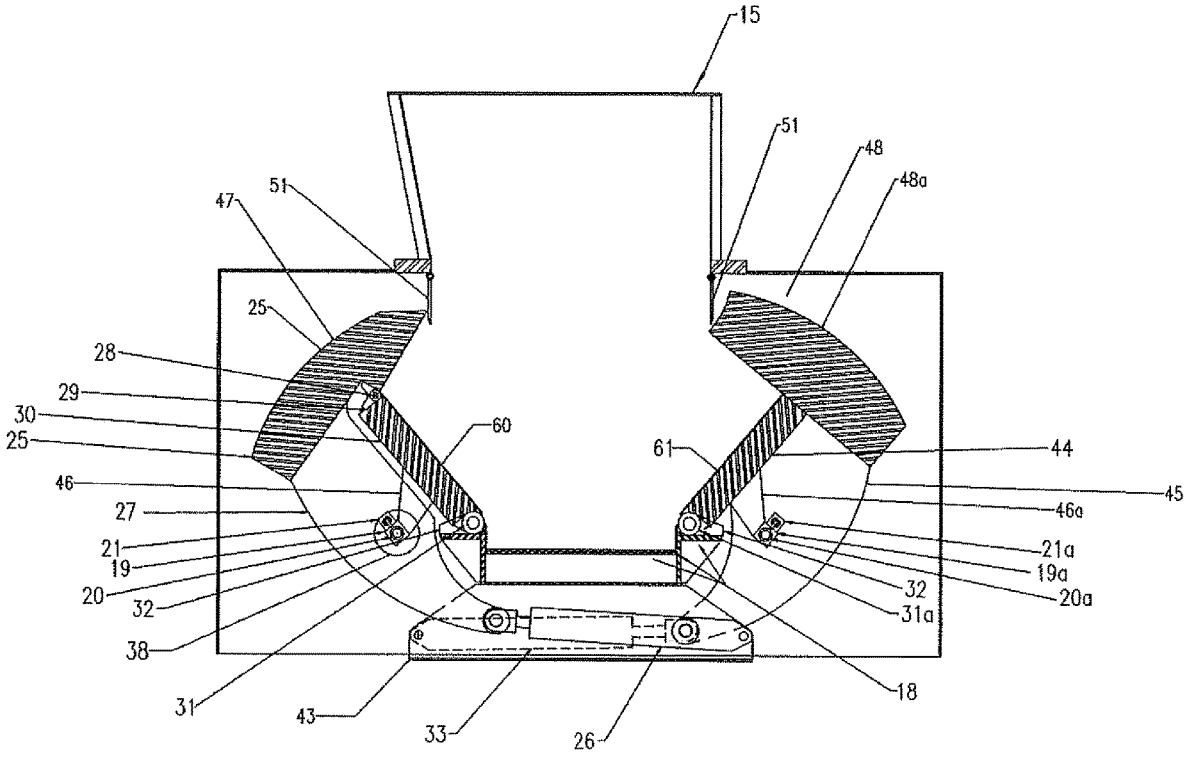
FIG. 8 illustrates the view of FIG. 6 with the pivoting opposing side walls (30, 44) and the pivoting left top cover (25) in the fully retracted position to receive waste material.
Figure 10:
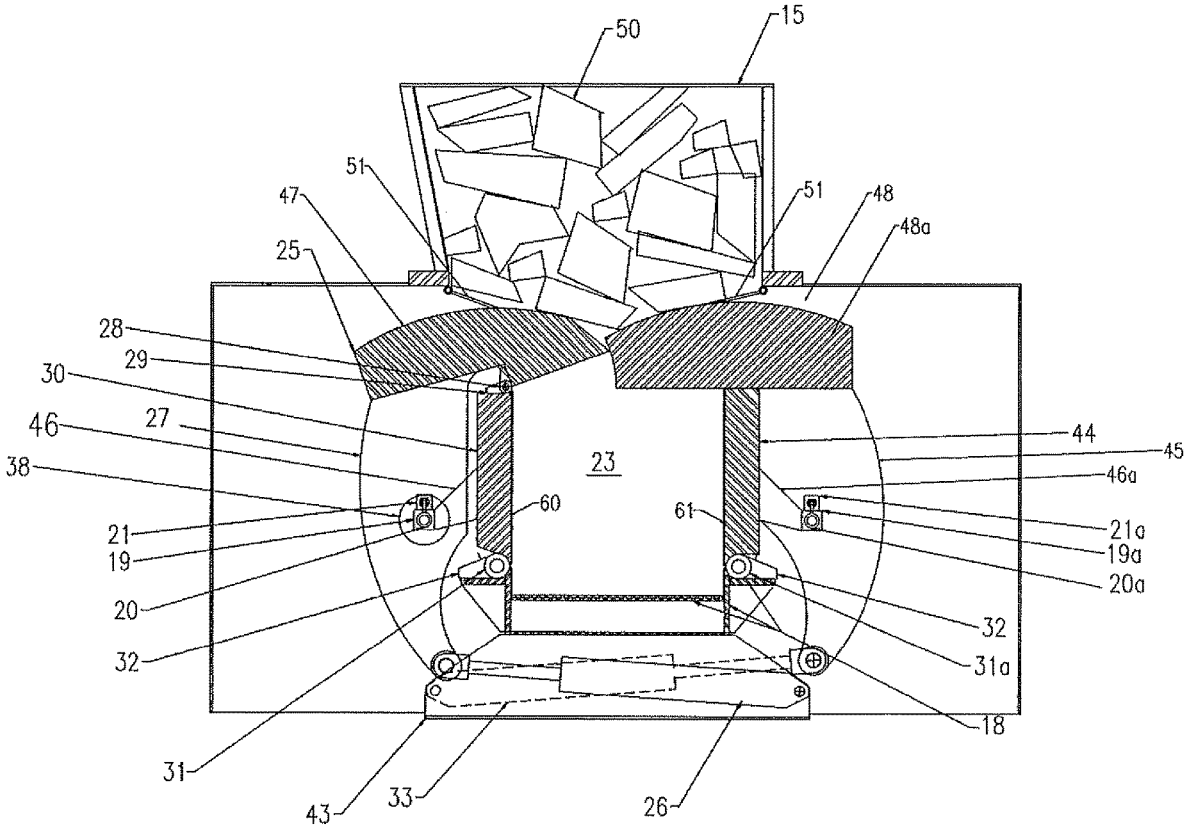
FIG. 10 illustrates the view of FIG. 6 with waste material (50) in the loading chamber (15) and the pivoting left top cover (25) retracted to align the left top cover actuating arm lock pin receptor (38) with the left lock pin (20)
Figure 11:
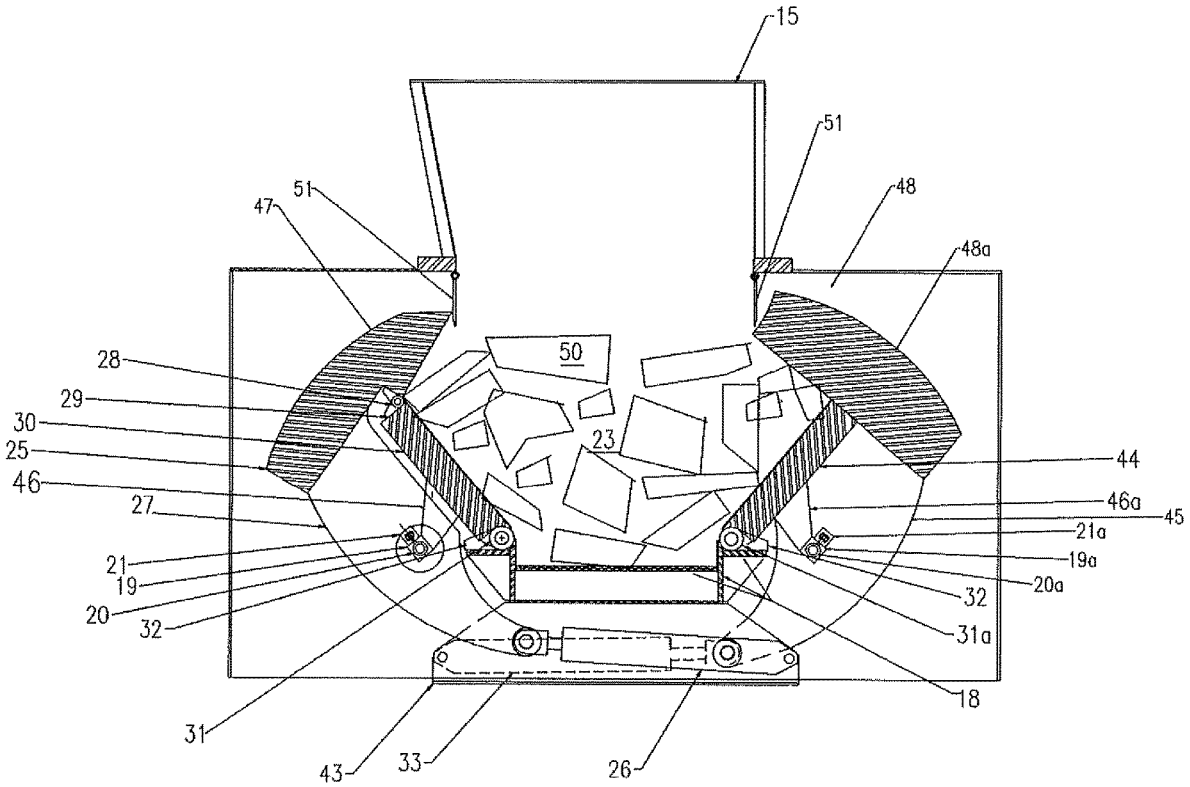
FIG. 11 illustrates the view of FIG. 6 with both pivoting left and right side walls (30, 44) and the pivoting left top cover (25) fully retracted with waste material (50) in the precompression charging chamber (23)
Figure 12:
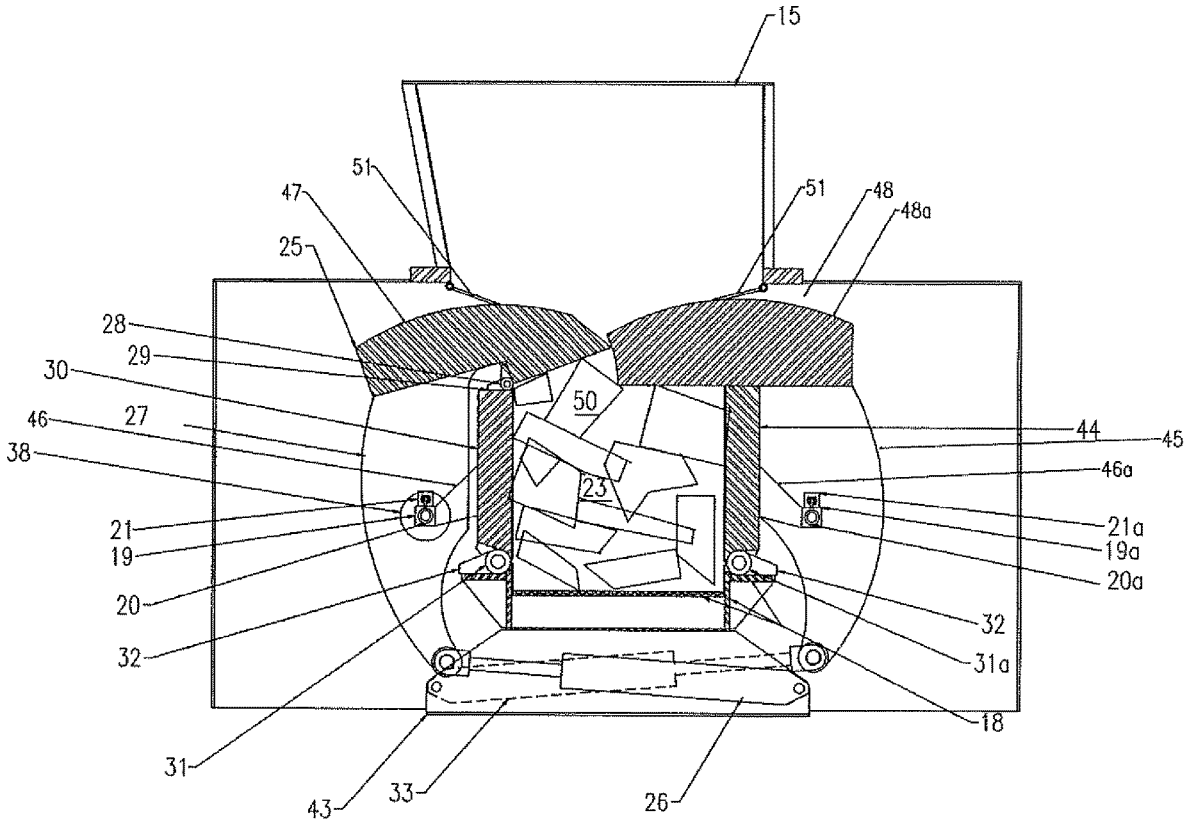
FIG. 12 illustrates the view of FIG. 6 with both pivoting left and right side walls (30, 44) closed with the waste material (50) compressed in the precompression charging chamber (23)

Referring now to FIGS. 1 and 2, a precompression charging chamber (23) with opposing pivoting left and right side walls (30) and (44), respectively, is mounted to, or aligned along, a frame structure (18). The frame (18) includes a main compression actuating cylinder (14), and a main compression ram (13), connected to, and positionable by, the main actuating cylinder (14) along a lower guide plate. The precompression charging chamber (23) has a variable geometry, wherein, the pivoting left and right side walls (30, 44) of the chamber are forcibly pivoted forward and retracted backward by individual left and right actuating cylinders (40) and (41), respectively, each being mounted to the compactor frame (18) at side wall actuating cylinder mounts (43). Each of the precompression charging chamber left and right side walls (30, 44) is mounted to a pivot mount (32) adjacent to the lower guide plate by shafts (not shown) that also pass through left and right side wall pivoting tubes (31) FIG. 3 and (31*a*) FIG. 5, respectively. The left and right side walls (30, 44) of the precompression charging chamber (23) have waste material contact surfaces (60) and (61), respectively, that are vertical in a closed and compacted condition (FIG. 6), and inclined in an open and expanded condition (FIG. 8). The waste material contact surfaces (60) and (61) of the pivoting left and right side walls (30, 44), respectively, contact and transform the loose waste material (50, FIG. 9) to a precompressed condition as they are forcibly pivoted to a vertical position in the closed and compacted condition (FIG. 12). As best seen in FIG. 5, the pivoting right side wall (44) has a side plate (44*a*) intersecting a non-pivoting right top cover plate (48), and a front edge plate (49) configured to conform to the radius created by the closing action of the pivoting left top cover plate (47) during compaction, as shown in FIG. 10 through 13. As well, pivoting right side wall actuating arm (45) is secured to both the right side plate (44*a*) and right top cover plate (48), as well as one end of right side wall actuating cylinder (33).

Figure 3:
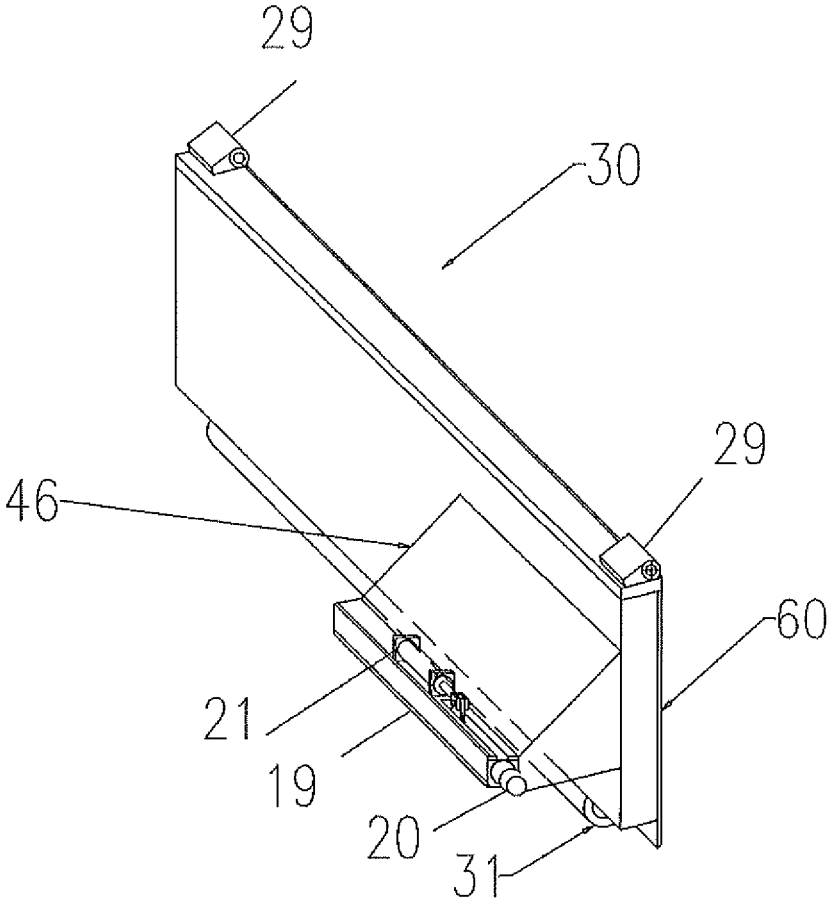
FIG. 3 illustrates an isometric view of a pivoting side wall member including a left lock mechanism (19, 20, 21) and pivot mounts (29) for attaching the pivoting left top cover (25)
Figure 4:
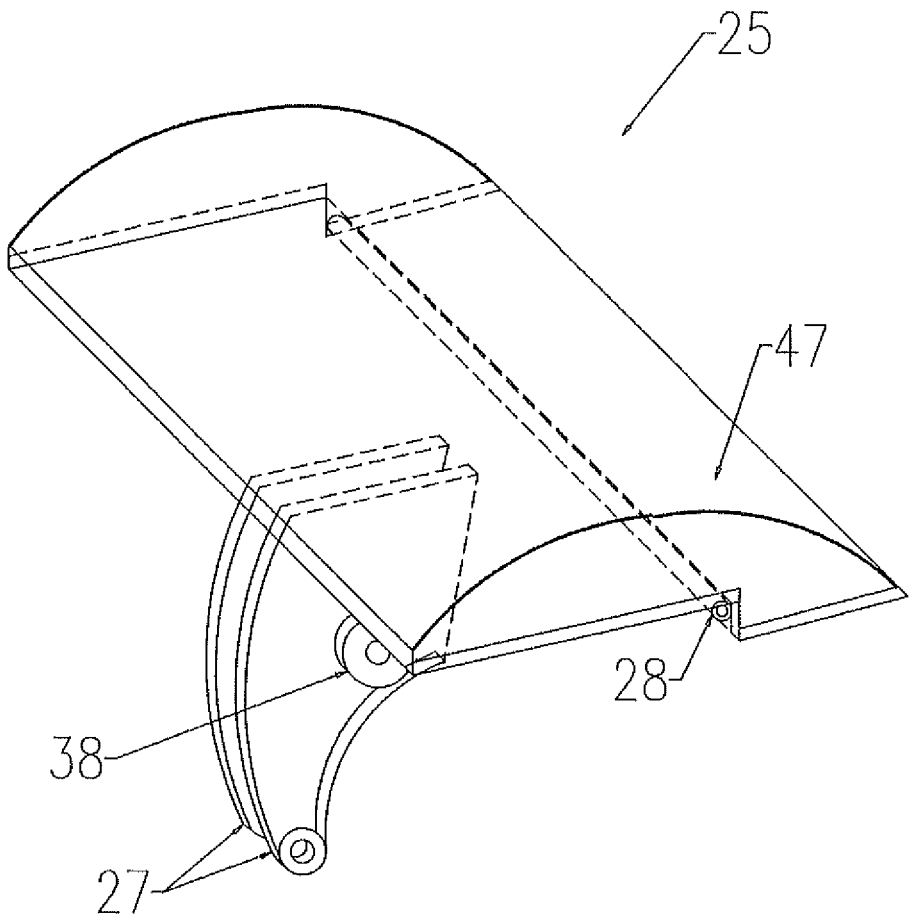
FIG. 4 illustrates an isometric view of a pivoting left top cover (25) member including a left actuating arm (27) with a lock pin receptor (38)
Figure 6:
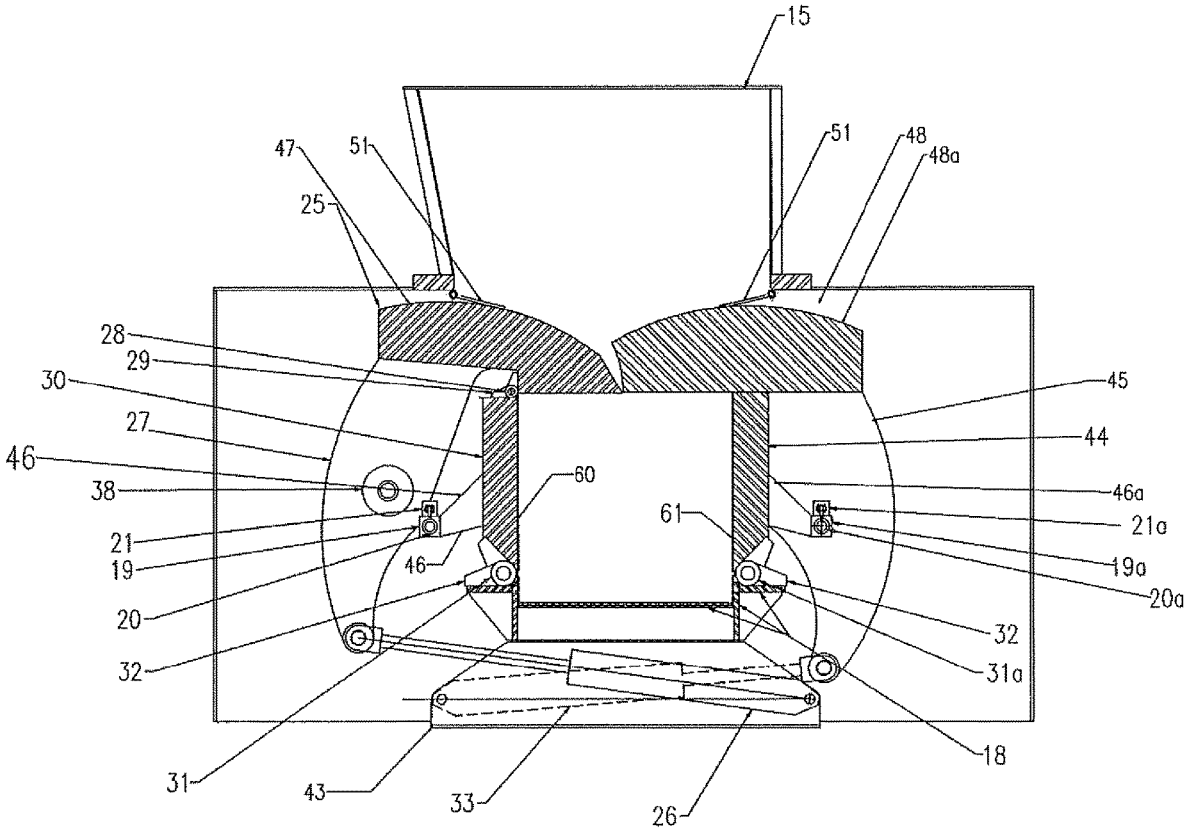
FIG. 6 illustrates an end view of the compactor (10) in partial cross section along line B-B of FIG. 1, depicting both the pivoting left and right side walls (30, 44) closed and locked in place vertically and parallel, the pivoting left top cover (25) is closed and held closed by the left lock actuating cylinder (21)
Figure 7:
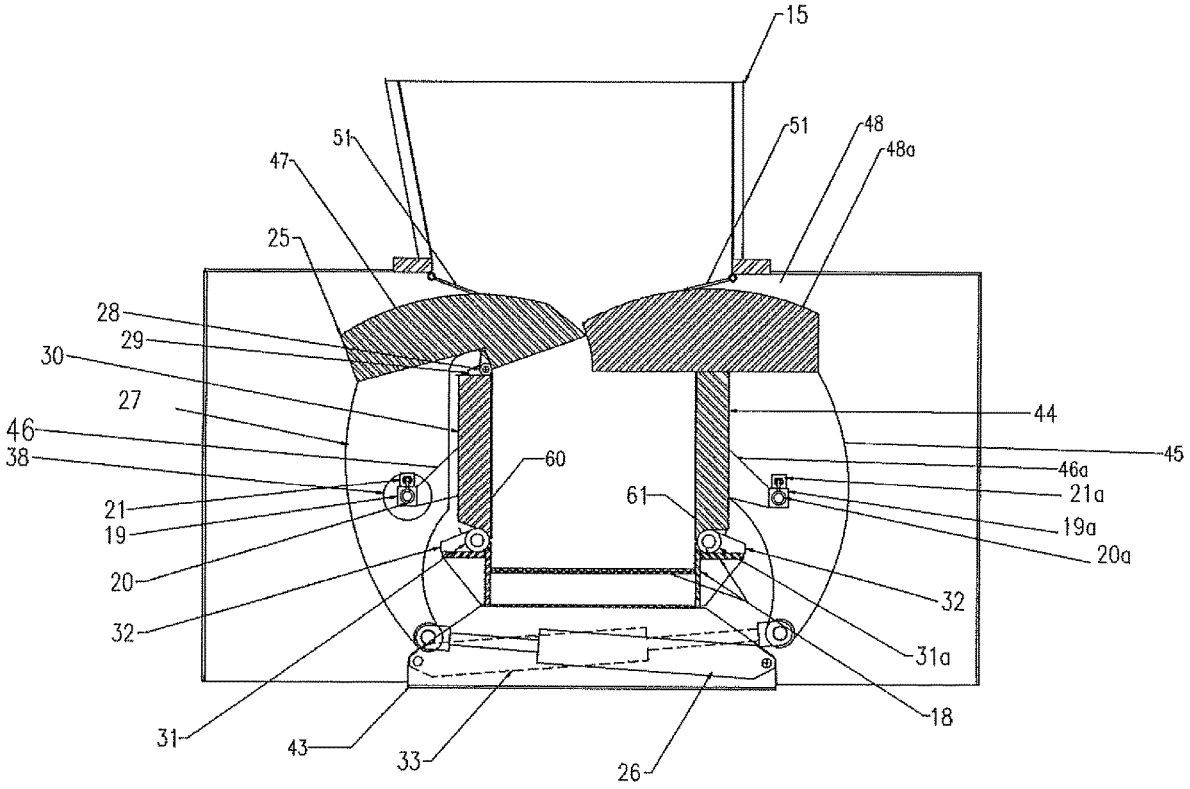
FIG. 7 illustrates a view of FIG. 6 with the left pivoting top cover (25) retracted and the left actuating arm (27) locked to the pivoting left side wall (30) as the lock pin (20) is retracted, thereby removing the front of the left lock pin (20) from the main frame left lock pin receptor (39), simultaneously inserting the rear of the left lock pin (20) into the left top cover actuating arm lock pin receptor (38), thereby interlocking the pivoting left side wall (30) and the pivoting left top cover (25); the right opposing side wall lock pin (20*a*) also retracts, unlocking the right side wall pin (20*a*) from the right main frame lock pin receptor (39*a*)

Referring now to FIGS. 3 and 4, a pivoting left side wall (30) includes a pivoting left top cover (25) which is forcibly advanced and retracted independently of the left side wall (30) by the same actuating cylinder (26) that advances and retracts the pivoting left side wall (30). Each of the pivoting left and right side walls (30, 44) is configured with an individual locking mechanism (19, 20, 21) and (19*a*, 20*a*, 21*a*), respectively, disposed in a corresponding left and right lock pin assembly mount (46) and (46*a*), respectively, that locks each pivoting side wall in a vertical and closed position during the precompression process (FIG. 6). As shown in FIGS. 2 and 3, the locking mechanism (19, 20, 21) for the pivoting left side wall (30), which includes the pivoting left top cover (25), is designed such that the left locking mechanism (19, 20, 21) also functions to interlock the pivoting left top cover (25) and the pivoting left side wall (30) together during the simultaneous advancing and retracting of the pivoting left side wall (30) and pivoting left top cover (25). Pivoting left top cover (25) is mounted to pivoting left side wall (30) by a shaft (not shown) that passes through left top cover pivot tube (28), with the opposing ends of the shaft being received in left top cover pivot mounts (29) that are on the top edge of left side wall (30).

Figure 9:
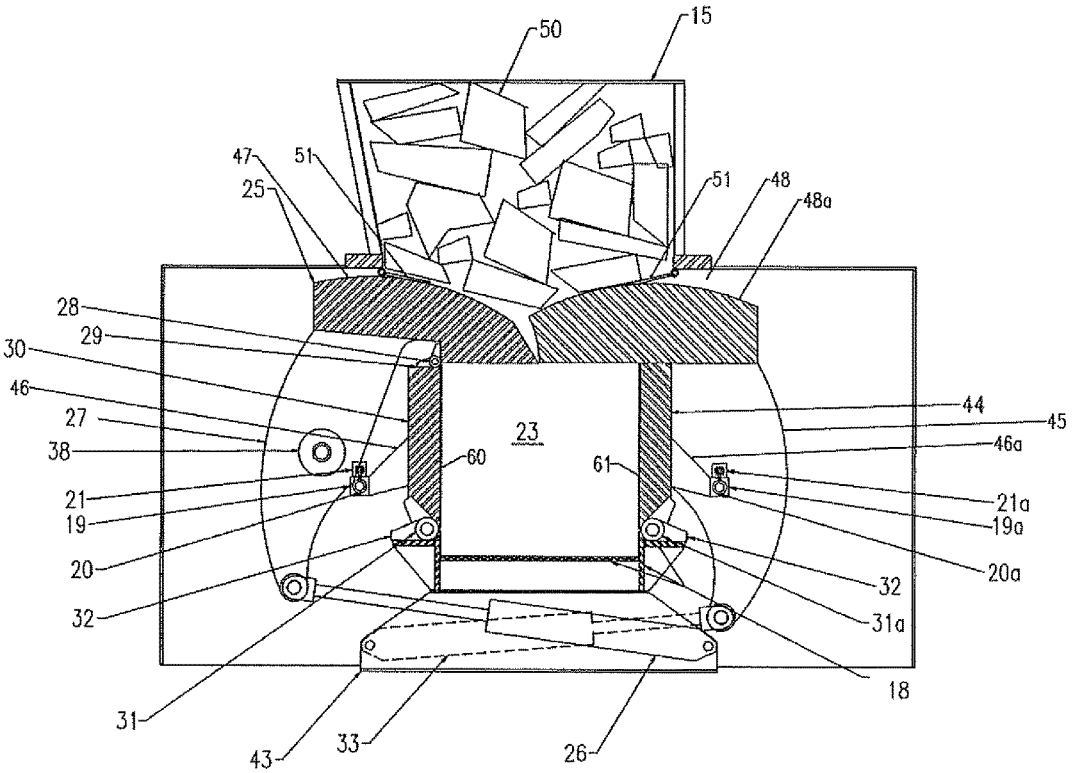
FIG. 9 illustrates the view of FIG. 6 with waste material (50) in the loading chamber (15) and the pivoting left and right side walls (30, 44) and pivoting left top cover (25) in the closed.

When the pivoting left side wall (30) is in its locked vertical position (FIG. 6), the left lock pin actuating cylinder (21) is activated to insert the front end of the left lock pin (20) into the front receptor (39) of the precompression chamber (23) left front wall, as shown in FIGS. 1 and 2. This movement of the left lock pin (20) removes the rear end of the left lock pin (20) from the left top cover (25) actuating arm receptor (38), thereby allowing the pivoting left side wall actuating cylinder (26) to continue advancing to close the left top pivoting cover (25) (FIGS. 11 through 13) as well. In order to retract the pivoting left top cover (25) and the pivoting left side wall (33) simultaneously, the pivoting left side wall actuating cylinder (26) retracts the left pivoting top cover (25) to a position that aligns the pivoting left top cover lock pin receptor (38) with the rear of the lock pin (20). The left lock pin actuating cylinder (21) then retracts the left lock pin (20) from the precompression chamber front wall lock pin receptor (39), thereby, simultaneously inserting the rear of the left lock pin (20) into the pivoting left top cover lock pin receptor (38). This action allows the pivoting left top cover actuating cylinder (26) to fully retract the pivoting left side wall (33) and pivoting left top cover (25) to their fully retracted and open position, as shown in FIGS. 9 through 11. The opposing pivoting right side wall locking actuating cylinder (21*a*) retracts its right lock pin (20*a*) simultaneously, thereby allowing the pivoting right side wall (44) to be retracted to its fully retracted and open position (FIG. 11) by the pivoting right side wall actuating cylinder (33).

Operation

Referring now to FIGS. 9 through 15, the use of the compactor (10) to form a bale from a loose material (50) is discussed. FIG. 9 illustrates a cross-sectional view along line B-B of FIG. 1, depicting the initial step in the use of the precompression charging chamber (23) in which the pivoting left side wall (30), pivoting left top cover (25), and pivoting right side wall (44) are vertically positioned by the left and right side wall actuating cylinders (26) and (33), respectively, thereby forming a closed precompression charging chamber (23). Loose waste material (50), which is to be fully precompressed by the precompression charging chamber (23) prior to a final compression step by way of a down line compression structure is delivered by various means to the top of the loading chamber (15). The loose waste material (50) is gravitationally delivered into the loading chamber (15) and rests on and is supported by the arcuate top plate (48*a*) of the right top cover (48) of the right pivoting side wall (44) and the arcuate plate (47) of the pivoting left top cover (25) of the pivoting left side wall (30).

FIG. 10 illustrates a cross-sectional view along general section line B-B of FIG. 1 depicting a subsequent step in the use of the precompression charging chamber (23) in which the pivoting left top cover (25) is retracted by left side wall actuating cylinder (26) in order to align the pivoting top left cover actuating arm lock pin receptor (38) with the rear of left lock pin (20), which is located in the left lock pin housing (19) (FIG. 3). When the left lock pin receptor (38) and the left lock pin (20) are aligned, the left side wall actuating cylinder (26) ceases its retraction and both left side wall lock pin actuating cylinder (21) and right side wall lock pin actuating cylinder (21*a*) are retracted. This action by the left and right side wall lock pin actuating cylinders (21 and 21*a*) retracts the left side wall lock pin (20) and right side wall lock pin (20*a*) from front main frame lock pin receptors (39) and (39*a*) (FIG. 2), respectively. As such, both left side wall (30) and right side wall (44) are simultaneously released from the precompression chamber front wall receptors (39) and (39*a*), respectively. As the front of left lock pin (20) is retracting from the left front frame receptor (39), the rear of left lock pin (20) is being inserted into the left top cover actuating arm receptor (38), thereby allowing the left side wall actuating cylinder (26) to simultaneously retract both the pivoting left top cover (25) and pivoting left side wall (30), with the pivoting left top cover (25) and the pivoting left side wall (30) being in fixed positions with respect to each other. The pivoting right side wall (44) is simultaneously retracted by right side wall actuating cylinder (33).

FIG. 11 illustrates a cross-sectional view along general section line B-B of FIG. 1, wherein the pivoting left top cover (25), pivoting left side wall (30), and pivoting right side wall (44) are fully retracted by the left and right actuating cylinders (26) and (33), respectively, to present an open and expanded precompression charging chamber (23) for accepting loose waste material (50). The retraction of the pivoting left top cover (25), the pivoting left side wall (30), and pivoting right side wall (44) also retracts the left and right arcuate crown plates (47) and (48*a*) that have been supporting the loose material (50) in the loading chamber (15). As this support is removed, the loose waste material (50) is allowed to gravitationally flow into the precompression charging chamber (23). Top cover wipers (51) help insure the loose waste material (50) is directed into the precompression charging chamber (23) as the left end and right arcuate crown plates (47) and (48*a*) pass underneath the wipers (51).

FIG. 12 illustrates a cross-sectional view along general section line B-B of FIG. 1, wherein the pivoting left side wall (30) and the pivoting right side wall (44) are advanced to their vertical, parallel, and closed positions. The left and right lock pins (20) and (20*a*) are advanced into the left and right front frame lock pin receptors (39) and (39*a*) (FIG. 1), respectively, thereby locking the pivoting left and right side walls (30) and (44) in place during the completion of the precompression and ultimate compression process. The process of advancing the left side wall locking pin (20) into the front frame lock pin receptor (39) also retracts the rear end of lock pin (20) from the pivoting left top cover (25) actuating arm (27) receptor (38). As such, the pivoting left actuating cylinder (26) is free to advance the pivoting left top cover (25) to its fully closed position.

Figure 13:
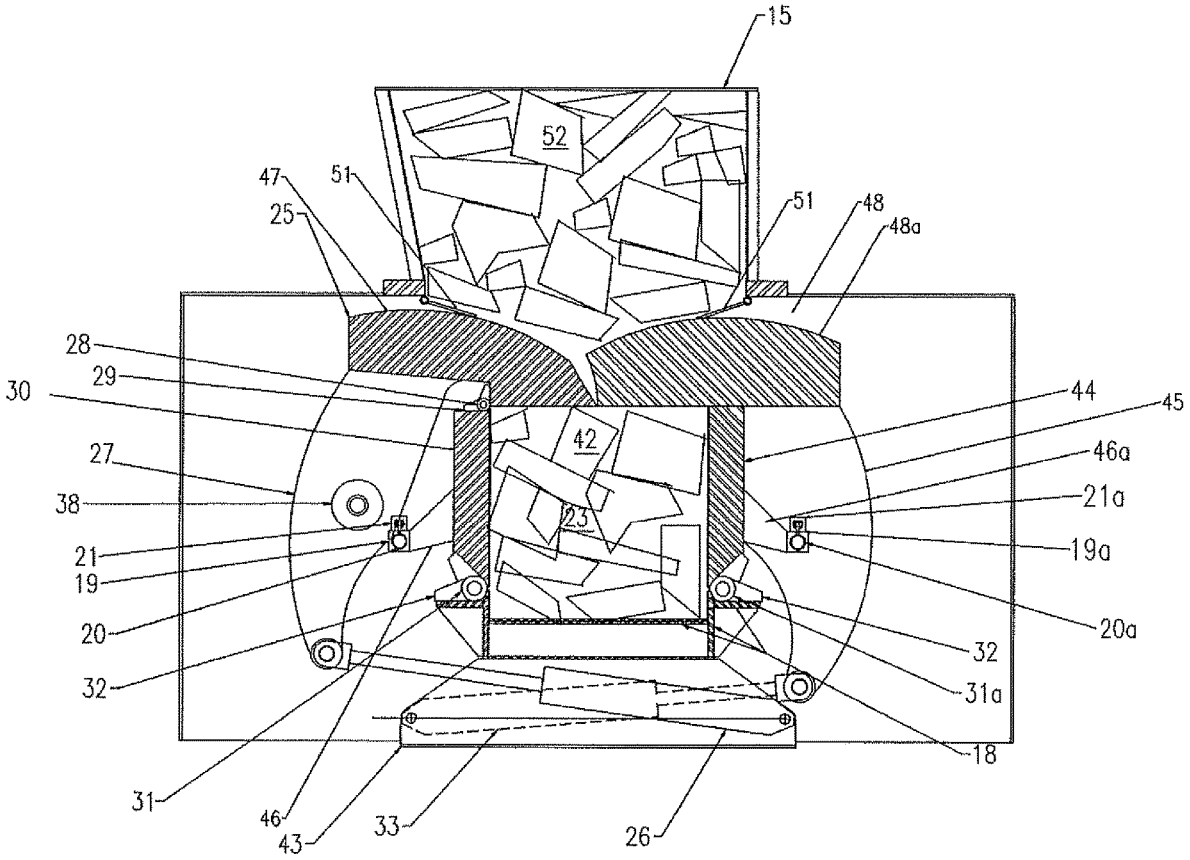
FIG. 13 illustrates a view of FIG. 6 with both pivoting left and right side walls (30, 44) locked vertically in place parallel to each other and the left pivoting top cover (25) closed.

FIG. 13 illustrates a cross-sectional view along general section line B-B of FIG. 1, wherein the pivoting left and right side walls (30, 44), and pivoting left top cover (25) are in their closed position after completing the precompression operation of waste material (50). The precompressed waste material (42) resides in the precompression charging chamber (23) until transferred by the ram face (16) of the main compression ram (13) to the downstream main compression chamber (24). The main compression chamber (24) is defined by left and right chamber side walls (35) and (35*a*), chamber top wall (34), chamber floor (34*a*), and main compression chamber door (36), which is held shut by door latch (37, FIG. 14). The loading chamber (15) is next filled with additional loose waste material (52) for the next precompression cycle.

Figure 14:
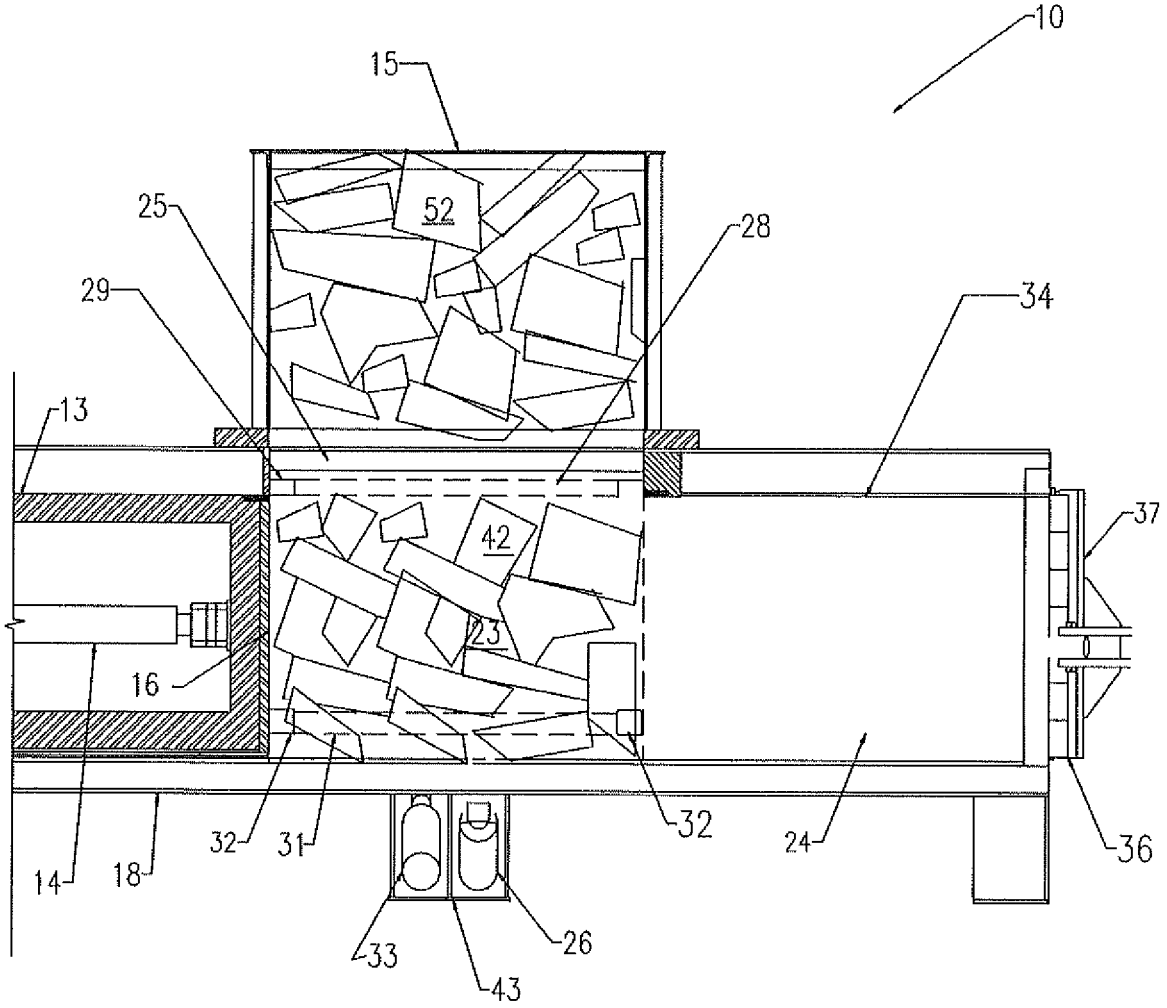
FIG. 14 illustrates a side view of the compactor (10) in partial cross section along line A-A of FIG. 1, depicting a precompressed charge (42) of loose waste material awaiting transfer to the main compression chamber (24), and the next charge of loose waste material (52) in the overhead loading chamber (15) awaiting transfer into the precompression charging chamber (23)

FIG. 14 illustrates a side view of the partial cross-section along lines A-A of FIG. 1, depicting a precompressed charge of loose waste material (42) awaiting forcible transfer to the main compression chamber (24). The next charge of loose waste material (52) in the overhead loading chamber is awaiting transfer into the precompression charging chamber (23).

Figure 15:
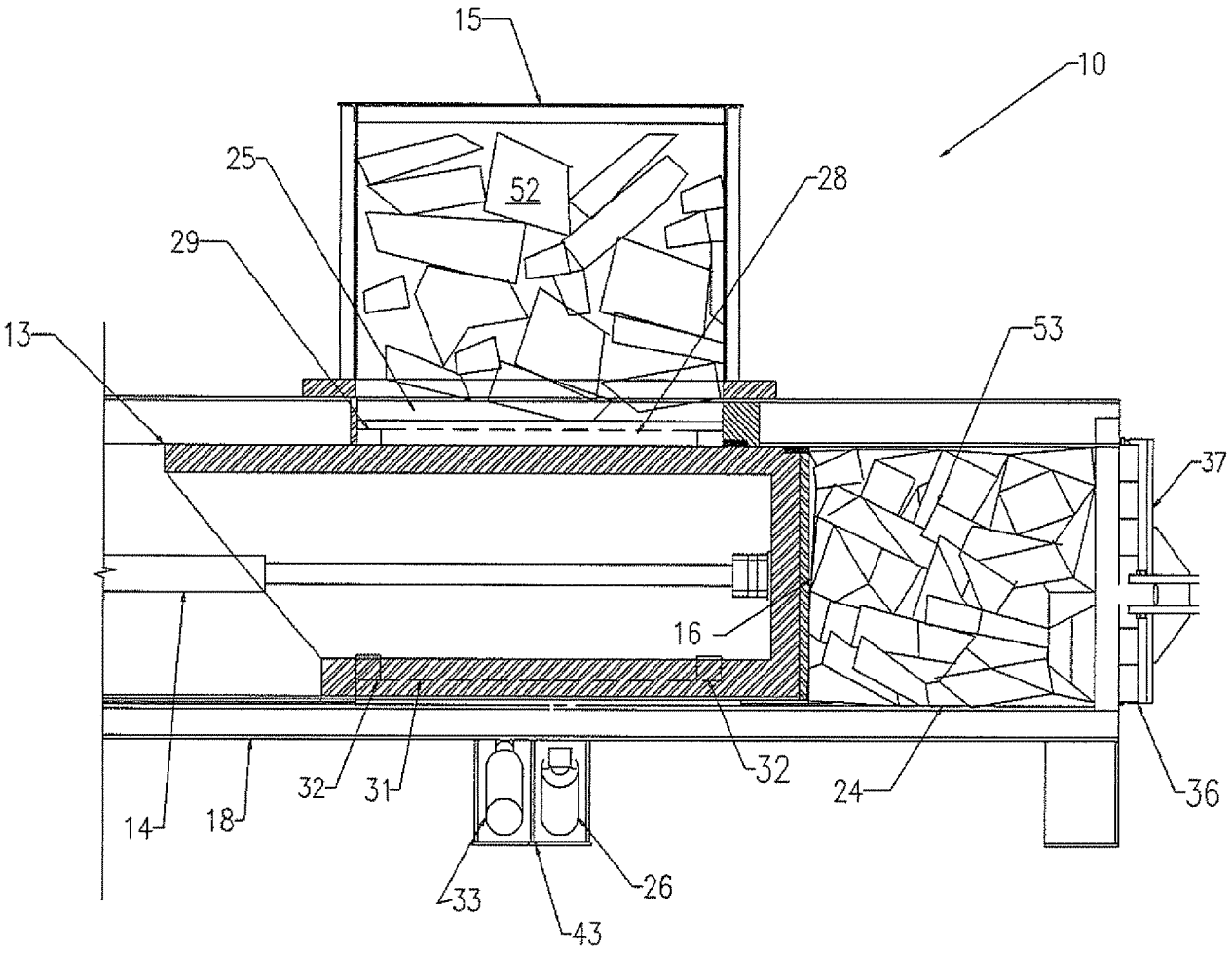
FIG. 15 illustrates a side view of the compactor (10) in partial cross section along lines A-A of FIG. 1 depicting a bale (53) being forcibly passed from the precompression charging chamber (23) into the representative main compression chamber (24)

FIG. 15 illustrates a side view in a partial cross-sectional view along general section lines A-A of FIG. 1, depicting the bale (53) having been forcibly passed from the precompression chamber (23) into the representative main compression chamber (24). To remove the bale (53) from main compression chamber (24), door latch actuator (4) opens door latch (37) so that door actuator (41) can open main compression chamber door (36), as best seen in FIG. 2.

Figure 16C:
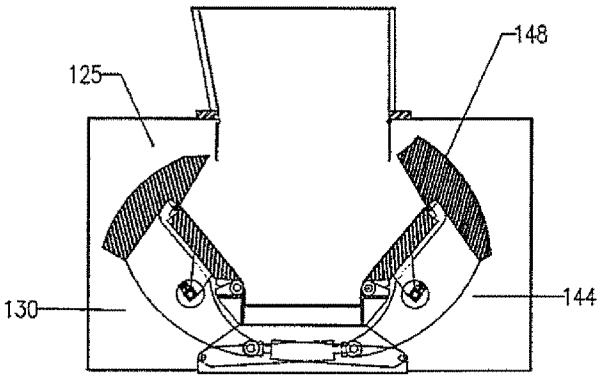
FIGS. 16A-16C depict cross-sectional views of an alternate embodiment of a precompression charging chamber configuration wherein, both left and right pivoting side walls (130*a*, 144) are each attached with pivoting top covers (125, 148)
Figure 16B:
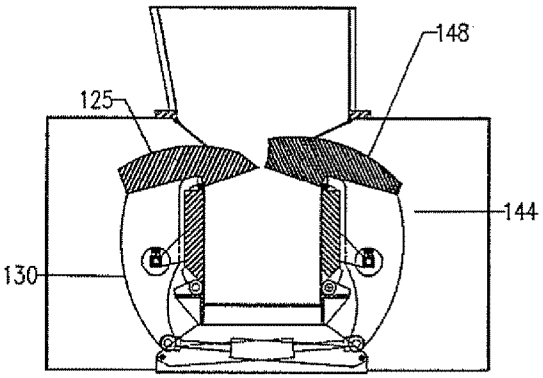
Figure 16A:
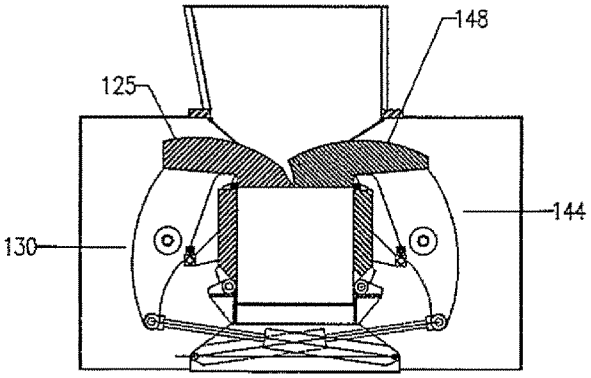
Figures 17A, 17B, 17C:
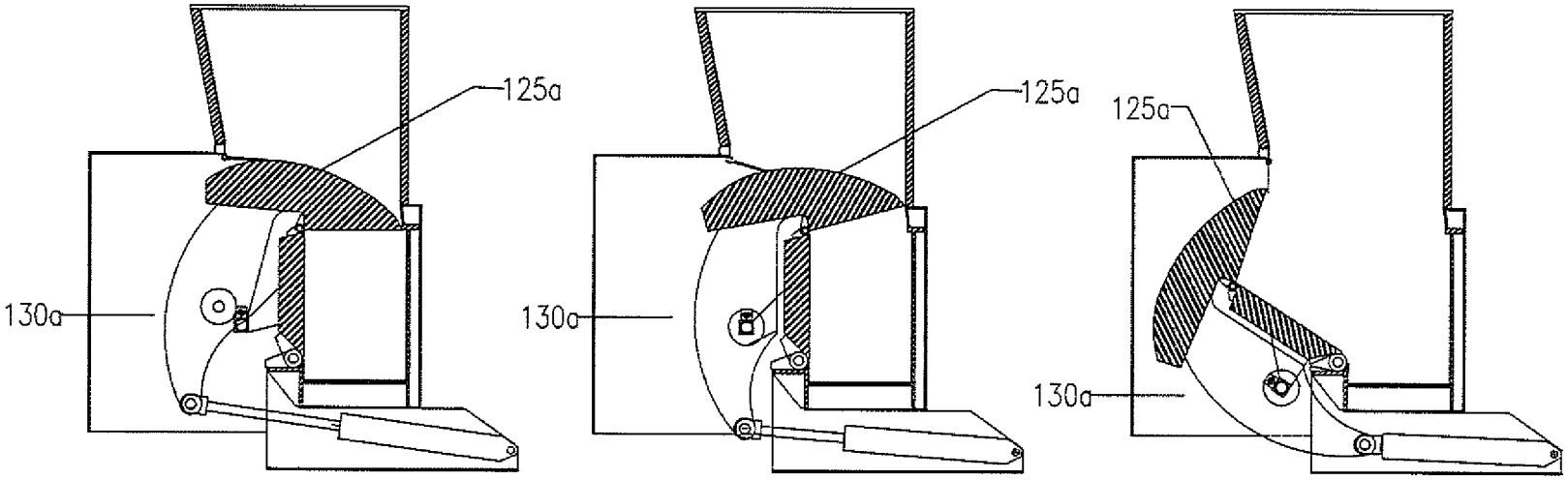
FIGS. 17A-17C depict cross-sectional views of an alternate embodiment of a smaller precompression charging chamber with a single pivoting side wall (130*a*) attached with a pivoting top cover (125*a*).

Referring now to FIGS. 16A through 16C, an alternate embodiment of the present invention could include a precompression charging chamber (23*a*) including pivoting left and right side walls (130) and (144) having pivoting left and right top covers (125) and (148), respectively. As well, yet another alternate embodiment of the present invention could include a precompression charging chamber (23*b*) having only one pivoting side wall (130*a*) with a pivoting top cover (125*a*), as shown in FIGS. 17A through 17C.

A list of the previously discussed elements in as follows:

10 Compactor
13 Main compression ram
14 Main compression actuating cylinder
15 Loading chamber
16 Compression ram face
18 Frame structure
19 Left lock pin housing
19*a* Right lock pin housing
20 Left lock pin
20*a* Right lock pin
21 Left lock pin actuating cylinder
21*a* Right lock pin actuating cylinder
23 Precompression charging chamber
24 Main compression chamber
25 Pivoting left top cover
26 Pivoting left side wall/pivoting left top cover actuating cylinder
27 Pivoting left top cover actuating arm
28 Left top cover pivot tube
29 Left top cover pivot mount
30 Pivoting left side wall
31 Left side wall pivoting tube
31*a* Right side wall pivoting tube
32 Sidewall pivot mount
33 Pivoting right side wall actuating cylinder

34 Main compression chamber top wall
34*a* Main compression chamber floor
35 Left main compression chamber side wall
35*a* Right main compression chamber side wall
36 Main compression chamber door
37 Main compression chamber door latch
38 Pivoting left top cover actuating arm lock pin receptor
39 Main frame left lock pin receptor
39*a* Main frame right lock pin receptor
40 Door lock actuator
41 Door actuator
42 Precompressed loose waste material charge
43 Pivoting side wall actuating cylinder mounts
44 Pivoting right side wall with integral top cover
44*a* Right side plate
45 Pivoting right side wall actuating arm
46 Left lock pin assembly mount
46*a* Right lock pin assembly mount
47 Pivoting left top cover arcuate crown plate
48 Non-pivoting right top cover
48*a* Non-pivoting right top cover arcuate crown plate
49 Pivoting right side wall top cover radiused front edge plate
50 Loose waste material
51 Top cover wiper
52 Additional loose waste material
53 Bale
60 Left waste material contact surface
61 Right waste material contact surface
125 Pivoting left top cover
130 Pivoting left side wall
144 Pivoting right side wall
148 Pivoting right top cover While one or more preferred embodiments of the invention are described above, it should be appreciated by those skilled in the art that various modifications and variations can be made in the present invention without departing from the scope and spirit thereof. It is intended that the present invention cover such modifications and variations as come within the scope and spirit of the appended claims and their equivalents.

What is claimed:

1. A precompression charging chamber for a loose material compactor having a frame, the precompression charging chamber comprising:

a bottom wall;

a left side wall that is pivotably mounted to the frame of the compactor so that the left side wall is movable from a first position in which the left side wall is perpendicular to the bottom wall to a second position in which the left side wall defines an obtuse angle with the bottom wall;

a left top cover that is pivotably mounted to a top edge of the left side wall, the left top cover including a left lock pin receptor; and a left lock pin that is secured to the left side wall, the left lock pin being movable from a first position in which a first end of the left lock pin is received within a left lock pin receptor disposed on the frame and a second position in which a second end of the left lock pin is received within the left lock pin receptor of the left top cover, wherein the left side wall is non-pivotably fixed to the frame when the first end of the left lock pin is in the first position, and the left top cover is non-pivotably fixed to the left side wall when the second end of the left lock pin is in the second position.

2. The precompression charging chamber of claim 1, wherein the left side wall is pivotable between the first and the second position with respect to the frame when the second end of the left lock pin is in the second position.

3. The precompression charging chamber of claim 2, wherein the left top cover is pivotable with respect to the left side wall and the frame when the left lock pin is in the first position.

4. The precompression charging chamber of claim 3, further comprising a left side wall actuating cylinder including a first end that is secured to the frame and a second end that is secured to the left top cover.

5. The precompression charging chamber of claim 4, further comprising a compression ram and a compression actuating cylinder, wherein the compression ram is movable along a longitudinal center axis of the compactor by the compression ram.

6. The precompression charging chamber of claim 5, wherein the left lock pin travels along an axis between the first position and the second position, and the axis is parallel to the longitudinal center axis of the compactor.

7. A compactor for loose material comprising:

a frame including a left lock pin receptor and;

a precompression charging chamber comprising:

a bottom wall;

a left side wall that is pivotably mounted to the frame of the compactor so that the left side wall is movable from a first position in which the left side wall is perpendicular to the bottom wall to a second position in which the left side wall defines an obtuse angle with the bottom wall;

a left top cover that is pivotably mounted to a top edge of the left side wall, the left top cover including a left lock pin receptor; and a left lock pin that is secured to the left side wall, the left lock pin being movable from a first position in which a first end of the left lock pin is received within the left lock pin receptor of the frame and a second position in which a second end of the left lock pin is received within the left lock pin receptor of the left top cover, wherein the left side wall is non-pivotably fixed to the frame when the first end of the left lock pin is in the first position, and the left top cover is non-pivotably fixed to the left side wall when the second end of the left lock pin is in the second position.

8. The compactor of claim 7, wherein the left side wall is pivotable between the first and the second position with respect to the frame when the second end of the left lock pin is in the second position.

9. The compactor of claim 8, wherein the left top cover is pivotable with respect to the left side wall and the frame when the left lock pin is in the first position.

10. The compactor of claim 9, further comprising a compression ram and a compression actuating cylinder, wherein the compression ram is movable along a longitudinal center axis of the compactor by the compression ram.

* * * * *